US006490817B1

(12) United States Patent
Jenkins

(10) Patent No.: US 6,490,817 B1
(45) Date of Patent: Dec. 10, 2002

(54) TIERED FILE FOLDER LABEL

(75) Inventor: Peter G. Jenkins, Elyria, OH (US)

(73) Assignee: Jeter Systems Corporation, Akron, OH (US)

( * ) Notice: Subject to any disclaimer, the term of this patent is extended or adjusted under 35 U.S.C. 154(b) by 0 days.

(21) Appl. No.: 09/633,905

(22) Filed: Aug. 7, 2000

(51) Int. Cl.[7] ..... B42F 21/04
(52) U.S. Cl. ..... 40/359; 40/641; 283/36
(58) Field of Search ..... 40/359, 360, 638, 40/641, 672, 674, 299.01, 539; 283/36, 37, 39, 41

(56) References Cited

U.S. PATENT DOCUMENTS 945,349 A * 1/1910 Tatham ..... 40/539 X
2,636,297 A * 4/1953 Johnson ..... 40/638
3,937,493 A * 2/1976 Fasbender ..... 40/359 X
4,143,477 A * 3/1979 Reynolds ..... 40/359
4,544,185 A * 10/1985 Spring ..... 283/81
5,016,370 A * 5/1991 Rhian et al. ..... 40/359
5,197,764 A * 3/1993 Hicinbothem et al. .... 40/359 X
6,145,883 A * 11/2000 Jeter ..... 40/359 X

* cited by examiner

*Primary Examiner*—Brian K. Green
(74) *Attorney, Agent, or Firm*—Renner, Kenner, Greive, Bobak, Taylor & Weber

(57) ABSTRACT

A file folder label for use on file folders having an exposed tiered edge is provided having a unitary label portion with at least one major and at least one minor tier section. The major tier section or sections and minor tier section or sections are provided to correspond with a major tier or tiers and a minor tier or tiers presented on the exposed edge of the file folder to which the tier file folder label is to be attached. The major and minor tier sections of the folder label are partially separable such that the major and minor tier sections can be partially separated and individually manipulated to conform to the corresponding tier on the file folder. Additionally, cut-out windows are provided on the folder label and help to partially separate major and minor tier sections. These windows also help in the alignment of the folder label when applying it to a file folder.

5 Claims, 3 Drawing Sheets

TIERED FILE FOLDER LABEL

TECHNICAL FIELD

The present invention relates generally to a label to be secured to an exposed edge of a file folder. More particularly, the present invention relates to a unitary file folder label that can be configured in multiple levels or tiers when applied to the edge of a file folder having a tiered exposed edge.

BACKGROUND OF THE INVENTION

The use of labels secured to exposed edges of file folders is well known in the art. Such labels are used in various businesses and professions to display information relating to the contents of the folder or the subject matter that the folder contains. Through the use of file folder labels, folders that are somewhat generic can be made more suitable for use in a given application. Additionally, using file folder labels eliminates the need for physically writing information on the exposed edges of the file folders. Inasmuch as these labels are commonly provided with pre-printed information, usually in the form of alphanumeric symbols, a label bearing the appropriate information can be readily selected or created and attached to the exposed edge of the file folder.

Generally, the exposed edge of the typical file folder is continuously linear and without any breaks. Therefore, a one piece label can be applied to the file folder edge simply by aligning the label with the file folder edge and thereafter folding the label so that it contacts both the front and back sides of the exposed edge. A suitable adhesive is either provided on or applied to the side of the label that is to contact the exposed edge such that the label can be folded over and secured to the exposed edge with the requisite file information presented thereon.

However, some file folders have a tiered edge, such as the exemplary tiered file folder 100 displayed in FIG. 1. Tiered file folder 100 includes a back flap 102 and a front flap 104. Back flap 102 includes tiered edge 106 having at least one minor tier section 108 and at least one major tier section 110. Particularly, in FIG. 1, two minor tier sections 108 are shown as located on each side of single major tier section 110. The distinction between minor tier section 108 and major tier section 110 is generally made by step 112.

Referring now to FIG. 2, it can be seen that, when front flap 104 of tiered file folder 100 is folded along one of any given score 114 to close upon back flap 102, tiered edge 106 is exposed such that useful file information may be viewed on tiered edge 106, particularly in the multitude of data slots 116 provided thereon.

As mentioned hereinabove, tiered edge 106 could simply be written upon, data slots 116 simply being filled in by hand to provide the requisite information; however, it is much more desirable to provide a file folder label displaying the desired information. Unfortunately, in the prior art a single, unitary file folder label has not been provided for file folders having tiered edges such as tiered edge 106. In the past, when it was desired to place a label on a file folder having tiered edges, the data was placed on by means of separate labels, with a separate label being applied to each tier on the folder's exposed edge. Employing an individual label associated with each tier adds to label costs and increases labor intensity by requiring that each label be individually applied to the tiered edge. Thus, there exists a need in the art for a tiered file folder label of unitary construction that can be applied to a tiered edge of a file folder.

OBJECTS OF INVENTION

In light of the foregoing, it is an object of the present invention to provide a folder label of unitary construction that can be applied to a tiered edge of a file folder and can conform to the tiered shape thereof.

It is another object of the present invention to provide a tiered file folder label, as above, that is constructed to have a major tiered section or sections corresponding with a major tier or tiers on a given tiered file folder and a minor tier section or sections corresponding with a minor tier or tiers on that given tiered file folder.

It is an additional object of the present invention to provide a tiered file folder label in combination with a file folder having an exposed edge including at least one major tier and at least one minor tier.

It is still another object of the present invention to provide a combination file folder and tiered file folder label, as above, wherein the tiered file folder label is of unitary construction and has at least one major tier section and at least one minor tier section corresponding, respectively, to the at least one major tier and at least one minor tier on the exposed edge of the file folder.

It is further aspect of the present invention to provide a method for applying a unitary file label to a file folder having an exposed edge including at least one major tier and at least one minor tier.

These and other objects of the present invention, which will become apparent from the description that follows, are achieved by the improvements to the folder label art hereinafter described and claimed.

In general, a folder label made in accordance with one embodiment of the present invention includes a unitary label portion having at least one major tier section and at least one minor tier section, the at least one major tier section being partially separable from the at least one minor tier section along a portion of said at least one major tier section such that the at least one major tier section and the at least one minor tier section may be partially separated in order to be individually manipulated to fold back on themselves at varying positions along the unitary label portion.

Other objects of the present invention are accomplished by a tiered file folder label in combination with a file folder having an exposed edge including at least one major tier and at least one minor tier, the combination including a unitary label portion having at least one major tier section and at least one minor tier section, the at least one major tier section being partially separated from the at least one minor tier section along a portion thereof such that the at least one major tier section and the at least one minor tier section are individually configured in separate levels to cover a respective major or minor tier of the file folder.

A preferred, exemplary tiered file folder label incorporating the concepts of the present invention is shown by way of example in the accompanying drawings without attempting to show all the various forms and modifications in which the invention might be embodied, it being understood that the invention is to be measured by the appended claims and not by the details of the specification.

PREFERRED EMBODIMENT FOR CARRYING OUT THE INVENTION

Figure 2:
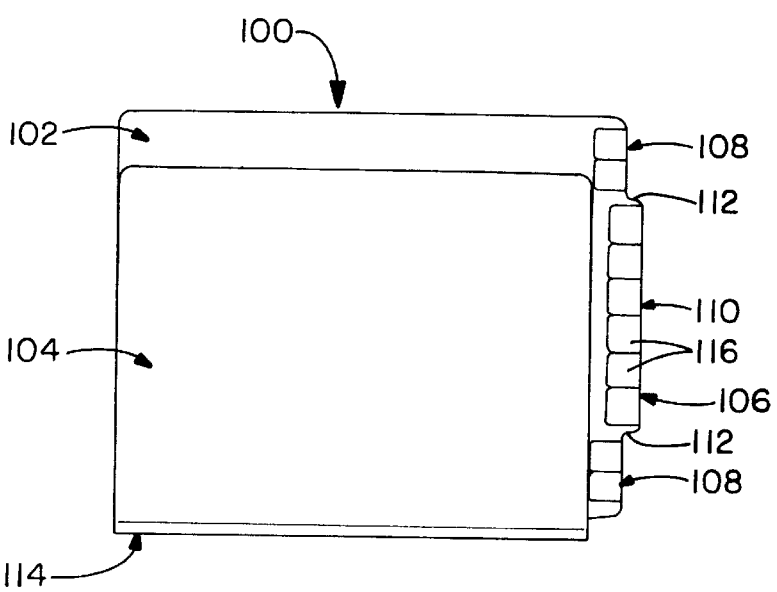
FIG. 2 is a front plan view of a tiered file folder having an exposed tiered edge, wherein the file folder is shown in a closed position with the tiered edge exposed.
Figure 3:
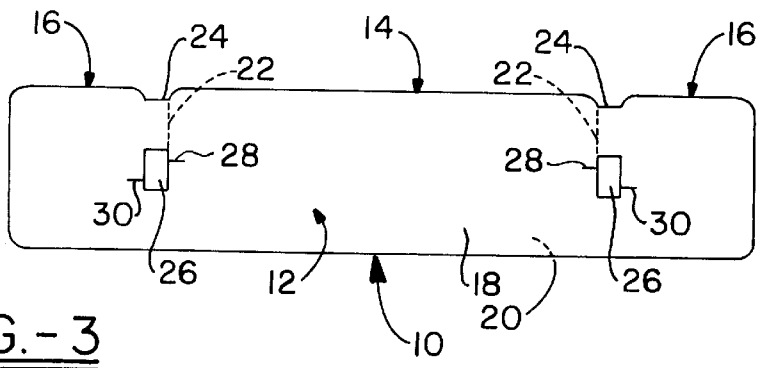
FIG. 3 shows a tiered file folder label in accordance with the present invention.
Figure 1:
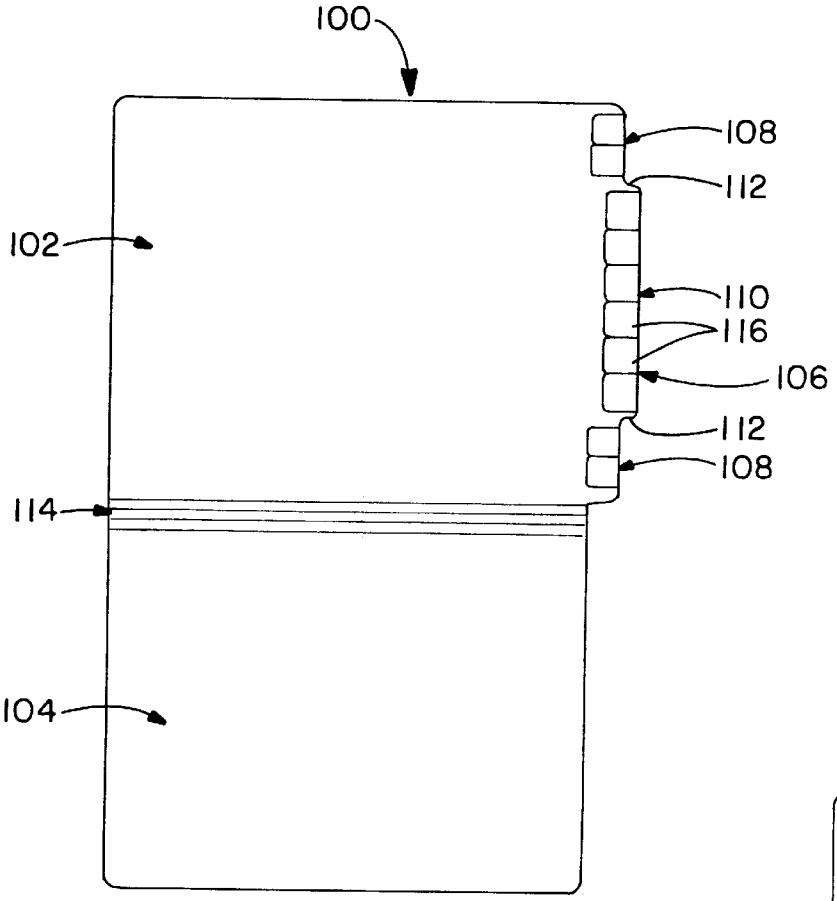
FIG. 1 is a front plan view of an exemplary tiered file folder having an exposed tiered edge, wherein the file folder is shown in a fully open position.

Referring now to FIG. 3, it can be seen that the tiered file folder label of the present invention is designated generally by the numeral 10. Folder label 10 includes a unitary label portion 12 having at least one major tier section 14 and at least one minor tier section 16. In the drawings of the present disclosure, unitary label portion 12 is shown as providing one major tier section 14 and two minor tier sections 16, although it should be understood that the present invention is not to be limited thereto or thereby inasmuch as the particular folder 100 and folder label 10 depicted in the drawings are merely exemplary in nature and have been chosen in order to disclose the best mode of the invention as currently contemplated. Of course, a given folder 100 could have various tiers at various levels such that a given folder label 10 would have to be configured accordingly to fit thereon in accordance with the teachings provided hereinbelow. It should be readily appreciated that, after having fully disclosed the form and function of the exemplary embodiment shown in the accompanying drawings, those of ordinary skill in the art will be able to conceive of how the aspects of this exemplary embodiment can be adapted for various types of folders having various tiered edge designs.

Inherently, unitary label portion 12 has a front side 18 and back side 20. Preferably, back side 20 of unitary label portion 12 provides a pressure sensitive adhesive layer (not shown) such that folder label 10 can be applied to a folder 100 simply by exposing the pressure sensitive adhesive material on backside 20 and bringing backside 20 into contact with exposed edge 106 of folder 100, as will be described more fully hereinbelow. However, the use of a pressure sensitive adhesive material is not necessary to practice that which is taught through the present disclosure, and the present invention should not be limited hereto or thereby.

Minor tier sections 16 are partially separable from major tier section 14 at perforations 22. Perforations 22 are preferred because they serve to maintain the structural integrity of unitary label portion 12 until, as described hereinbelow, they must be torn to apply folder label 10 to a file folder 100. However, perforations 22 need not be provided or, alternatively, perforations 22 could be provided as a pre-cut division between major tier section 14 and minor tier sections 16.

Each perforation 22 extends from an outer edge 24 of label portion 12 to a respective window 26. Windows 26 provide separate areas in unitary label portion 12 that are devoid of material and, therefore, also provide some degree of partial separation between major tier section 14 and minor tier section 16. When perforations 22 are broken from outer edge 24 to window 26, major tier section 14 and each minor tier section 16 can be individually manipulated, although unitary label portion 12 remains of single-piece construction. This ability to individually manipulate major tier section 14 and each minor tier section 16 allows file folder label 10 to be applied to a file folder 100 having an exposed tiered edge 106 by the method described hereinbelow.

Figure 4:
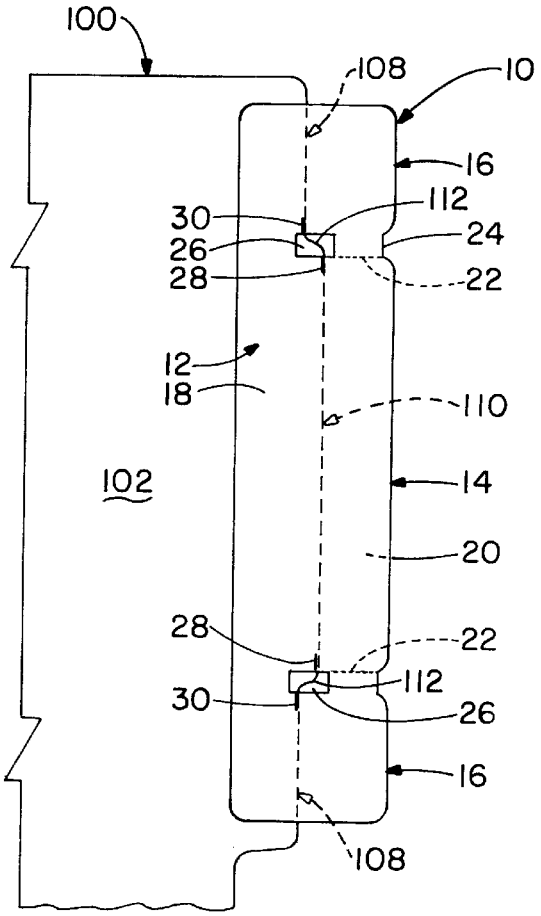
FIG. 4 shows a tiered file folder label according to the present invention as it is being applied to a file folder having an exposed tiered edge.

Referring now to FIG. 4, it can be seen that folder label 10 is aligned over tiered edge 106 of back flap 102 such that major tier section 14 aligns with major tier 110 and each minor tier section 16 aligns with a respective minor tier 108. Step 112, which helps to define the transition from minor tiers 108 to major tier 110 are used to facilitate the alignment process by viewing steps 112 through windows 26 provided on folder label 10. To further facilitate the alignment process, hash marks 28 may be provided on major tier section 14 running to windows 26 as shown in FIG. 4. Hash marks 28, if employed, would indicate the proper positioning at major tier section 14. Proper alignment could also be achieved by providing hash marks 30 on minor tier section 16 to indicate the proper positioning of major tier section 14. The use of both hash marks 28 and 30 is shown in FIG. 4. It should be readily appreciated that windows 26 define a tolerance for the positioning of folder label 10 such that hash marks 28 and/or 30 may be placed at various positions proximate and extending to windows 26.

As mentioned hereinabove, unitary label portion 12 preferably has a pressure sensitive adhesive layer on back side 20. Therefore, in a preferred embodiment of the present invention, the pressure sensitive adhesive layer of label portion 12 is exposed and folder label 10 is then aligned as described portion 12 is exposed hereinabove and adhered to folder 100 as shown in FIG. 4 by pressing the pressure sensitive adhesive layer of label portion 12 on to tiered edge 106. In an alternative, although not necessarily preferred, embodiment of the present invention, folder label 10 need not provide a pressure sensitive adhesive layer and, therefore, folder label 10 would be applied to folder 100 as shown in FIG. 4 by application of a chosen adhesive or attachment means such as, for instance, by applying an adhesive such as glue to back side 20 of label portion 12.

When folder label 10 is aligned on folder 100 as shown in FIG. 4 and adhered thereto in the area of contact, perforations 22 can then be broken such that major tier section 14 and each minor tier section 16 can be individually folded over tiered edge 106 of folder 100 such that folder label 10 substantially conforms to the shape of tiered edge 106. However, when proper alignment is achieved by positioning folder label 10 such that transitions 112 overlap with a portion of backside 20, perforations 22 should first be broken before adhering folder label 10 to tiered edge 106 so that undesirable portions of minor tier sections 16 do not adhere to the front of tiered edge 106. Preferably, transitions 112 fall completely within windows 26 such that perforations 22 may be separated subsequent to adhering folder label 10 to tiered edge 106.

Figure 5:
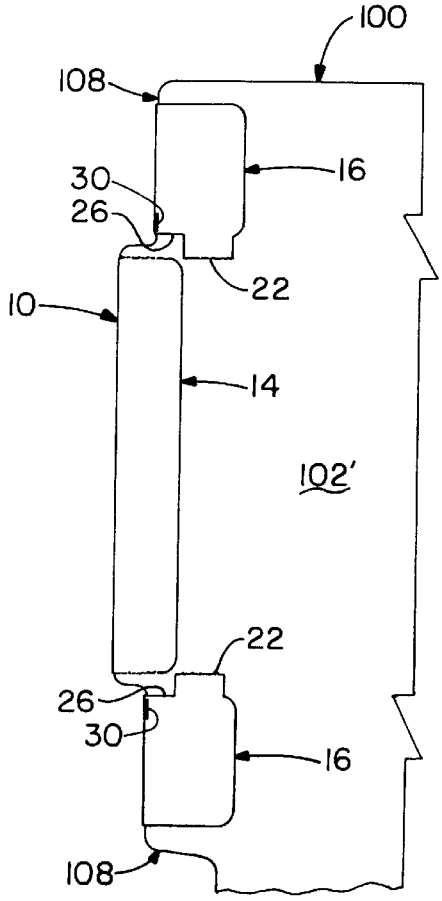
FIG. 5 is an exploded rear plan view of a tiered file folder having a tiered file folder label according to the present invention attached to its tiered edge.

In FIG. 5, the reverse side of back flap 102 is depicted and designated by the numeral 102'. In this figure, major tier section 14 and minor tier section 16 have been individually manipulated to fold back on themselves at varying positions along unitary label portion 12 so as to conform with the shape of tiered edge 106. Therein, it can be seen that minor tier sections 16 are capable of folding over minor tiers 108 due to the fact that minor tier sections 16 are partially separated from major tier section 14 by broken perforations 22 as well as window 26. Notably, windows 26 provide an area wherein steps 112 may reside without interfering with the manipulation of minor tier sections 16.

Figure 6:
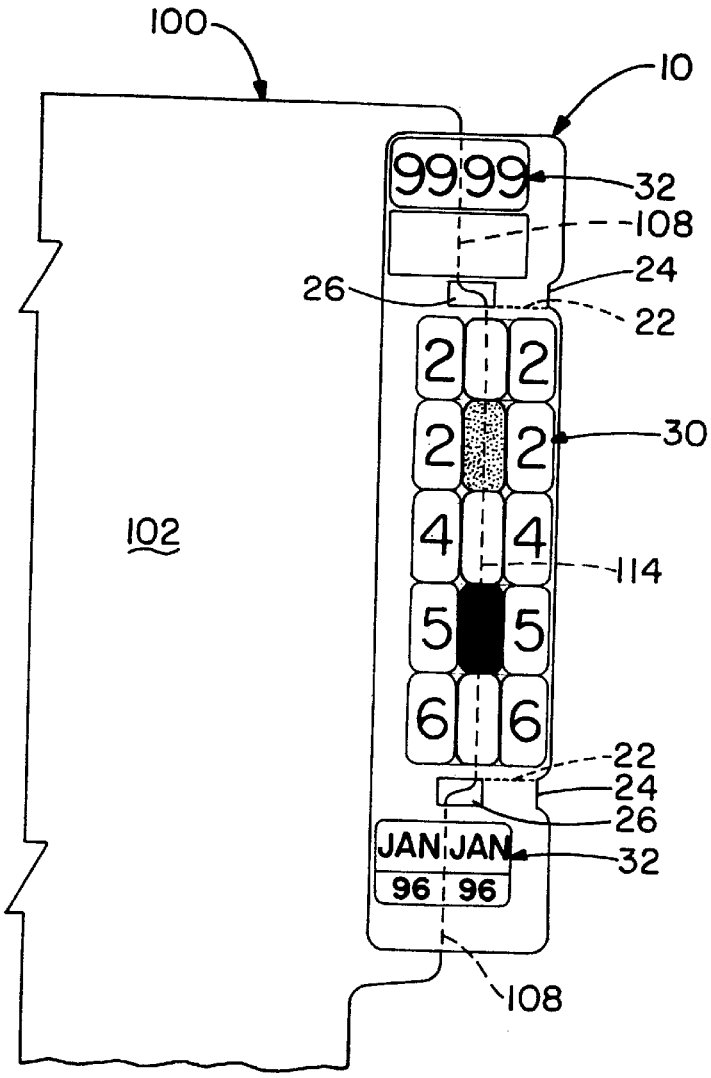
FIG. 6 shows an indicia-bearing tiered file folder label according to the present invention as it is being applied to a file folder having an exposed tiered edge.

Referring now to FIG. 6, a more specific embodiment of the present invention is disclosed. Therein, folder label 10 is shown as having indicia 30 printed on major tier section 14 and indicia 32 printed on minor tier sections 16. Notably, indicia 30 and indicia 32 are provided having a symmetry such that, when major tier section 14 and each minor tier section 16 is folded over tiered edge 106 of folder 100, identical information is displayed on each side 102 and 102' of folder 100 at tiered edge 106. Due to a configuration of indicia 30, 32, the information provided by folder label 10 may be perceived despite whether the folder 100 to which it is attached is lying face up or face down.

In light of the foregoing, it should thus be evident that a tiered file folder label constructed as described herein as substantially improves the art and otherwise accomplishes the objects of the present invention. Furthermore, the form and functioning of the tiered file folder label of the present invention, of which folder label 10 is a preferred embodiment, should be readily understood such that the particular embodiment herein described may be altered for differently shaped tiered edge designs that may exist for different file folders.

While in accordance with the patent statutes only the best mode and preferred embodiment of the present invention has been presented and described in detail, it is to be understood that the invention is not limited thereto or thereby. Accordingly, for an appreciation of the true scope and breath of the invention, reference should be made to the following claims.

What is claimed is:

1. A tiered file folder label in combination with a file folder comprising:

the file folder having an exposed edge including at least one major tier and at least one minor tier; and a unitary label having at least one major tier section and at least one minor tier section, wherein said at least one major tier section is partially separated from said at least one minor tier section along a portion of said unitary label, and said major tier section is individually folded to cover said at least one major tier of the file folder, while said at least one minor tier section is individually folded to cover said at least one minor tier of the file folder.

2. The combination file folder and tiered file folder label of claim 1, wherein said unitary label further comprises a window located proximate to where said at least one major tier section is partially separated from said at least one minor tier section.

3. The combination file folder and tiered file folder label of claim 1, further comprising indicia on said at least one major tier section and said at least one minor tier section of said unitary label.

4. The combination file folder and tiered file folder label of claim 3, wherein said unitary label further comprises adhesive on one side thereof, and said at least one major tier section and said at least one minor tier section cover their respective major and minor tier of the file folder by being individually folded thereover with said adhesive contacting the respective tiers.

5. The combination file folder and tiered file folder label of claim 4, wherein said indicia is positioned on said at least one major tier section and said at least one minor tier section such that identical information is provided on the front and back sides of said major and minor tiers of the file folder.

* * * * *